US010483675B2

(12) United States Patent
Nishiyama et al.

(10) Patent No.: US 10,483,675 B2
(45) Date of Patent: Nov. 19, 2019

(54) CONNECTOR WITH PROTRUSIONS NEAR CONTACT PIECES

(71) Applicants: YAZAKI CORPORATION, Tokyo (JP); TOYOTA JIDOSHA KABUSHIKI KAISHA, Toyota-shi, Aichi (JP)

(72) Inventors: Noritaka Nishiyama, Makinohara (JP); Masao Nagano, Makinohara (JP); Takahito Nakashima, Okazaki (JP)

(73) Assignees: YAZAKI CORPORATION, Minato-ku, Tokyo (JP); TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 15/304,115

(22) PCT Filed: Mar. 27, 2015

(86) PCT No.: PCT/JP2015/059733
§ 371 (c)(1),
(2) Date: Oct. 14, 2016

(87) PCT Pub. No.: WO2015/159688
PCT Pub. Date: Oct. 22, 2015

(65) Prior Publication Data

US 2017/0040731 A1 Feb. 9, 2017

(30) Foreign Application Priority Data

Apr. 17, 2014 (JP) ..... 2014-085425

(51) Int. Cl.
*H01R 13/41* (2006.01)
*H01R 31/08* (2006.01)
(Continued)

(52) U.S. Cl.
CPC ..... *H01R 13/41* (2013.01); *H01R 11/01* (2013.01); *H01R 13/42* (2013.01); *H01R 31/08* (2013.01)

(58) Field of Classification Search
CPC ..... H01R 13/641; H01R 13/42; H01R 13/64; H01R 31/08; H01R 13/5219
(Continued)

(56) References Cited

U.S. PATENT DOCUMENTS 5,403,204 A 4/1995 Chishima et al.
5,456,617 A 10/1995 Chishima et al.
(Continued)

FOREIGN PATENT DOCUMENTS

JP 58-160482 U 10/1983
JP 61-194282 U 12/1986
(Continued)

OTHER PUBLICATIONS

Search Report dated Jun. 23, 2015, issued by the International Searching Authority in counterpart International Patent Application No. PCT/JP2015/059733 (PCT/ISA/210).
(Continued)

*Primary Examiner* — Abdullah A Riyami
*Assistant Examiner* — Nader J Alhawamdeh
(74) *Attorney, Agent, or Firm* — Sughrue Mion, PLLC

(57) ABSTRACT

A connector (10) includes terminals (12), a bus bar (11), and a housing (14). Electric wires (19) are connected to the terminals (12). The bus bar (11) electrically connects the terminals. The housing (14) has terminal receiving chambers (16) and a bus bar receiving chamber (15). The terminals (12) are received in the terminal receiving chambers (16). The bus bar (11) is received in the bus bar receiving chamber (15). The bus bar has contact pieces (24), a coupling portion (25), and support portions (26). The support portions (26)
(Continued)

extend from both end portions of the coupling portion. A position where the contact pieces make contact with contact point portions and a position where protrusions (29*a*, 29*b*) provided in the support portions are locked to the bus bar receiving chamber are aligned with each other in a longitudinal direction of the housing.

7 Claims, 6 Drawing Sheets

(51) Int. Cl.
*H01R 11/01* (2006.01)
*H01R 13/42* (2006.01)

(58) Field of Classification Search
USPC ..... 439/723, 272
See application file for complete search history.

(56) References Cited

U.S. PATENT DOCUMENTS 5,496,188 A 3/1996 Okamura et al.
5,662,487 A 9/1997 Okamura et al.
6,746,279 B1 * 6/2004 Lopez ..... H01R 9/2458 439/620.01
2012/0326698 A1 * 12/2012 Watanabe ..... H01R 31/08 324/66
2013/0303016 A1 * 11/2013 Shimizu ..... H01R 13/4223 439/374
2015/0244106 A1 * 8/2015 Miyakawa ..... H01R 13/113 439/345
2015/0340790 A1 * 11/2015 Hamai ..... H01R 13/4223 439/660
2017/0040731 A1 * 2/2017 Nishiyama ..... H01R 13/41

FOREIGN PATENT DOCUMENTS

JP 2-101474 U 8/1990
JP 6-176832 A 6/1994
JP 6-349555 A 12/1994
JP 2012-174432 A 9/2012
JP 2012174432 A * 9/2012 ..... H01R 13/4223
WO 2013069224 A1 5/2013

OTHER PUBLICATIONS

Written Opinion dated Jun. 23, 2015, issued by the International Searching Authority in counterpart International Patent Application No. PCT/JP2015/059733 (PCT/ISA/237).
Written Opinion (PCT/ISA/237) dated Jun. 23, 2015 issued by the International Searching Authority in counterpart International Application No. PCT/JP2015/059733.
Communication dated Feb. 11, 2017, from the State Intellectual Property Office of People's Republic of China in counterpart Application No. 201580020328.2.
Communication dated Feb. 7, 2019, issued by the Indian Intellectual Property Office in counterpart Indian Patent Application No. 201647035381.

* cited by examiner

CONNECTOR WITH PROTRUSIONS NEAR CONTACT PIECES

TECHNICAL FIELD

The present invention relates to a connector.

BACKGROUND ART

A connector (e.g. a joint connector) in which terminals of electric wires of a wire harness etc. are electrically connected to one another is mounted in a moving body such as a car. For example, this type of connector includes female type terminals, a bus bar, and a housing. The electric wires are connected to the female type terminals. The bus bar electrically connects the terminals to one another. The housing made of an insulating resin is electrically insulated. The housing is formed to have terminal receiving chambers and a bus bar receiving chamber. The terminals are received in the terminal receiving chambers. The bus bar is received in the bus bar receiving chamber. The bus bar is formed in such a manner that contact pieces extending in one and the same direction are coupled by a coupling portion. The contact pieces are configured so that elastically contactable contact point portions formed in one end portions of the terminals make contact with the contact pieces respectively (see Patent Literature 1).

FIG. 5 is a transverse sectional view showing a state in which a bus bar is received in a housing of this type of connector. FIG. 6 is a longitudinal sectional view showing a state in which the bus bar and terminals received in the housing are connected. As shown in FIG. 5, the bus bar 51 is formed to have contact pieces 52 and a coupling portion 53 which couple these contact pieces 52. Protrusions 54 are provided on widthwise opposite sides of the coupling portion 53. The bus bar 51 is inserted into a bus bar receiving chamber 56 of the housing 55 as follows. That is, the bus bar 51 moves forward while pressing the protrusions 54 against an inner wall of the bus bar receiving chamber 56. Then, the bus bar 51 is retained in a stop position.

On the other hand, terminals 58 are inserted into terminal receiving chambers 57 formed in the housing 55 respectively. As shown in FIG. 6, the terminals 58 are positioned at lances 59 in set positions of the terminal receiving chambers 57, and the contact pieces 52 of the bus bar 51 are inserted into electric connection portions 60 of the terminals 58. Each of the electric connection portions 60 is shaped like a rectangular cylinder on its front end side. The contact pieces 52 inserted into the electric connection portions 60 are pressed against elastic arms 61 which are contact point portions folded back on inner sides of the electric connection portions 60. As a result, the terminals 58 and the bus bar 51 are connected, and the terminals 58 are electrically connected to one another through the bus bar 51.

CITATION LIST

Patent Literature

Patent Literature 1: JP-A-2012-174432

SUMMARY OF INVENTION

Technical Problem

The housing used in this type of connector is formed out of a synthetic resin etc. Therefore, when temperature changes, volume change, i.e. dimensional change, caused by expansion or contraction may occur. Particularly, a longitudinal (axial) dimension of the housing changes relatively largely in comparison with any other dimension of the housing.

For example, in the connector shown in FIGS. 5 and 6, a position P1 of each of the protrusions 54 of the bus bar 51 and a position P2 where the bus bar 51 makes contact with the contact point portions (elastic arms 61) of the electric connection portions 60 of the terminals 58 are disposed at a relatively far distance from each other in the longitudinal direction of the housing 55. Therefore, when the volume change caused by expansion or contraction occurs in the housing 55, dimensional change corresponding to a volume change rate of the distance between the position P1 and the position P2 occurs so that the position P2 moves relatively to the position P1. That is, displacement in contact portions between the bus bar 51 and the terminals 58 occurs. As a result, due to friction occurring between the bus bar 51 and the terminals 58, plating may be peeled from the surfaces of the bus bar 51 and the terminals 58. Thus, there is a fear that rust may occur in the bus bar 51 or the terminals 58 or electric resistance of the contact portions may increase.

The invention has been accomplished in consideration of such a problem. An object of the invention is to suppress displacement in contact portions between terminals and a bus bar, which is caused by volume change of a housing.

Solution to Problem

The foregoing object of the invention can be attained by the following configurations.

(1) A connector including: a plurality of terminals configured to connect to electric wires; a bus bar configured to electrically connects the terminals to one another; and a housing that includes a plurality of terminal receiving chambers and a bus bar receiving chamber, the terminal receiving chambers configured to receive and position the plurality of terminals therein, and the bus bar receiving chamber configured to receive the bus bar; wherein the bus bar comprises a plurality of contact pieces, a coupling portion, and support portions, the contact pieces being brought into contact with elastically contactable contact point portions provided in the plurality of terminals, the plurality of contact pieces extending in one and the same direction, the coupling portion coupling the contact pieces, the support portions extending in the extension direction of the plurality of contact pieces from both end portions of the coupling portion in its widthwise direction respectively, protrusions being provided in the support portions and being configured to be locked to the bus bar receiving chamber; and wherein a position where the plurality of contact pieces make contact with the contact point portions of the plurality of terminals and a position where the protrusions are locked to the bus bar receiving chamber are set to be aligned with each other in a longitudinal direction of the housing.

According to the aforementioned configuration (1), it is possible to reduce the influence of volume change of the housing. Accordingly, it is possible to make a contact state between the terminals and the bus bar stable so that it is possible to suppress displacement between the terminals and the bus bar. In addition, the bus bar has the protrusions provided in the support portions which are different from the contact pieces. Accordingly, it is possible to provide the protrusions in desired positions so that it is possible to enhance the degree of freedom in designing the bus bar.

(2) A connector according to the aforementioned configuration (1), wherein: the plurality of contact pieces, the coupling portion and the support portions are provided on one and the same plane in the bus bar.

According to the aforementioned configuration (2), it is possible to provide the protrusions in desired positions without increasing thickness of the bus bar.

Advantageous Effects of Invention

According to the invention, it is possible to suppress displacement in contact portions between the terminals and the bus bar, which is caused by volume change of the housing.

DESCRIPTION OF EMBODIMENT

Figure 1:
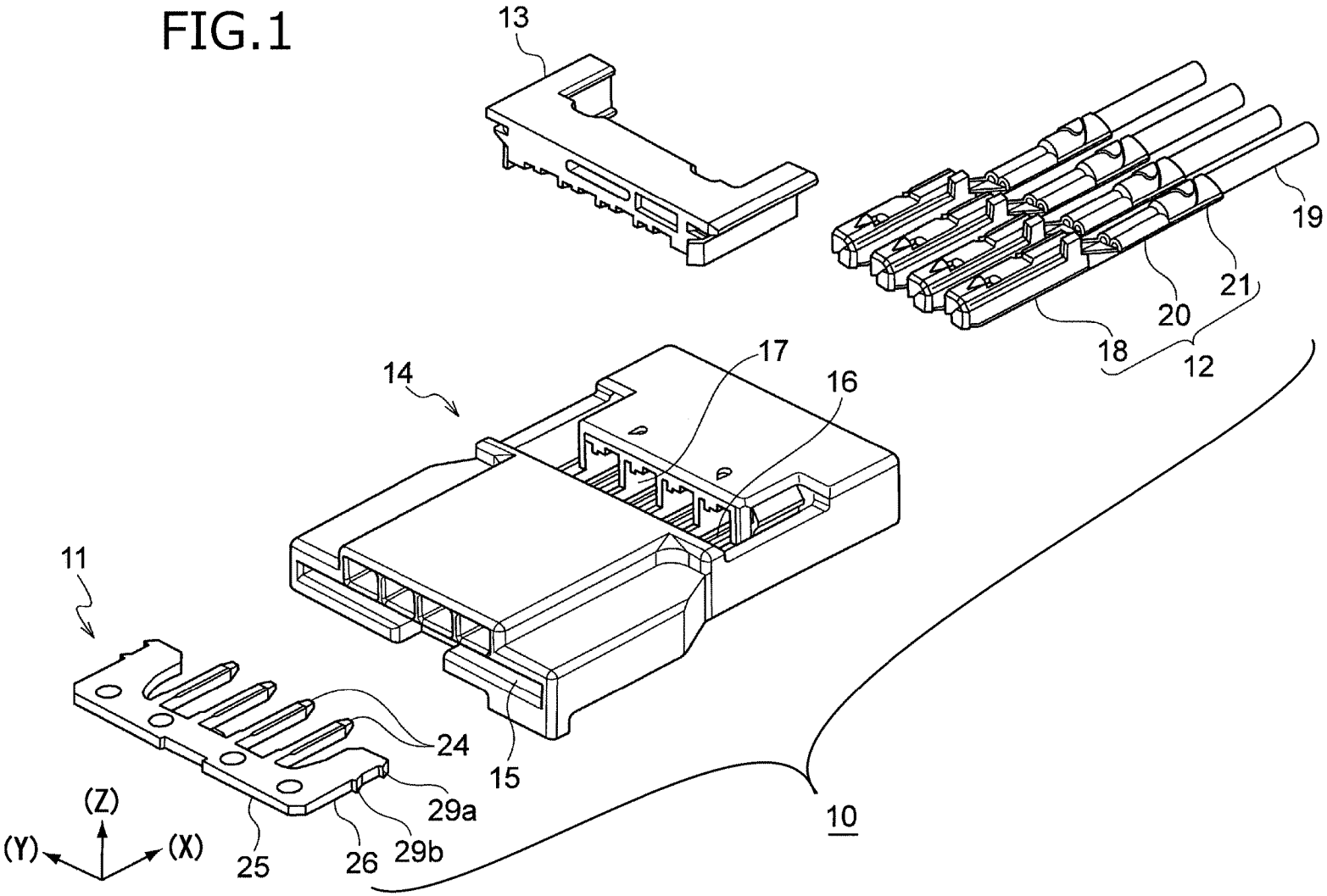
FIG. 1 is an exploded perspective view of a connector to which an embodiment of the invention is applied.
Figure 2:
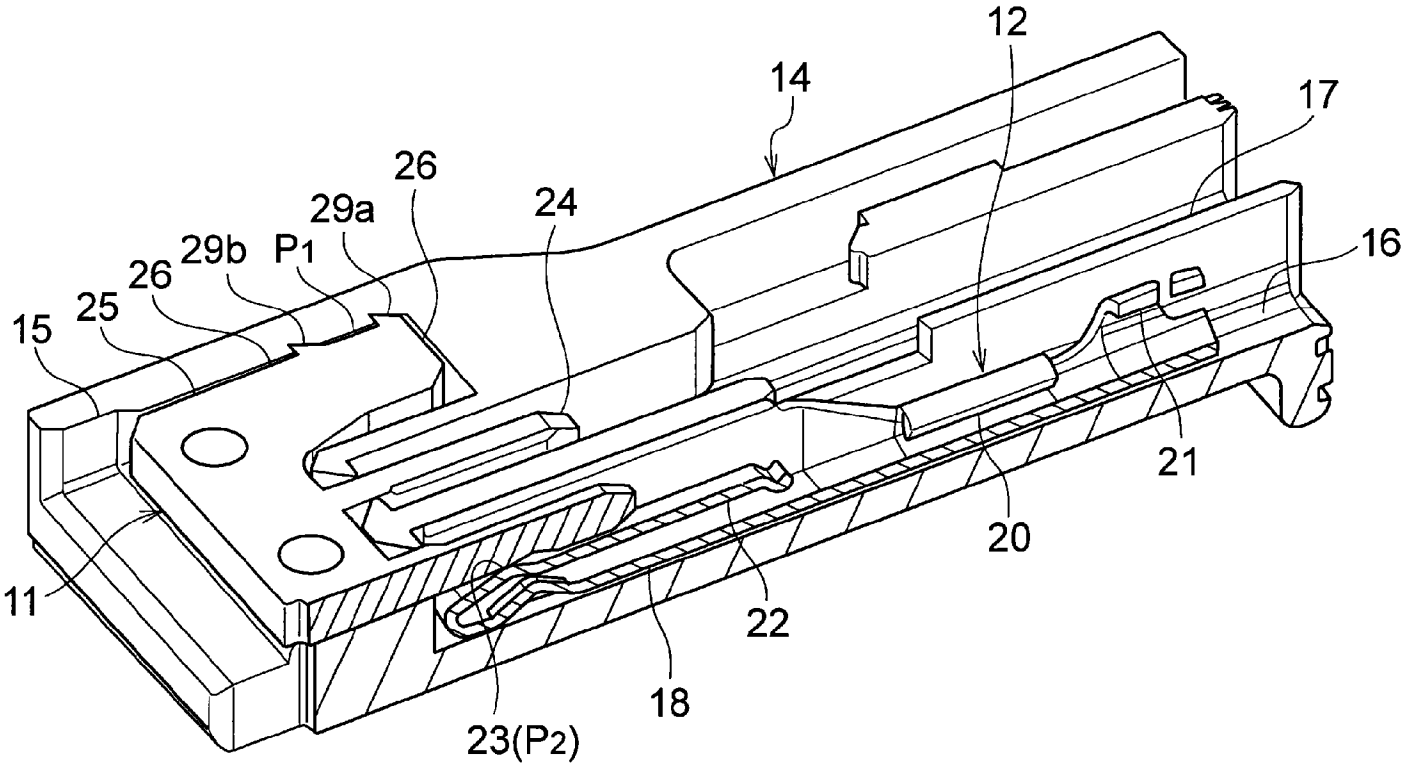
FIG. 2 is a perspective sectional view of the connector to which the embodiment of the invention is applied.

An embodiment of a connector to which the invention is applied will be described below with reference to the drawings. FIG. 1 is an exploded perspective view of the connector to which the embodiment of the invention is applied. FIG. 2 is a partially sectional view of the connector which has been assembled. A state in which the connector in FIG. 1 has been turned upside down is shown in FIG. 2. In FIG. 1, an arrow (X) expresses a front/rear direction (an axial direction, which is a longitudinal direction) of the connector, an arrow (Y) expresses a width direction of the connector, and an arrow (Z) expresses a thickness direction of the connector. Incidentally, these definitions will be also applied to description of the other drawings suitably.

The connector 10 according to the embodiment includes a bus bar 11, a plurality of (four in the embodiment) female type terminals 12 to which electric wires are connected, a retainer 13, and a housing 14 which is made of an insulating resin. The bus bar 11 is a metal conductor for electrically connecting the terminals 12 to one another. The housing 14 is formed to have a bus bar receiving chamber 15 which receives the bus bar 11, and a plurality of (four) terminal receiving chambers 16 which receive the terminals 12.

The housing 14 is formed into a rectangular cylinder shape having openings in its front end portion, rear end portion and side surface portion respectively. The bus bar receiving chamber 15 is formed to extend inward from the opening in the front end portion. Each of the terminal receiving chambers 16 is formed to extend inward from the opening in the rear end portion. The bus bar receiving chamber 15 and the terminal receiving chambers 16 are formed to communicate with each other in the longitudinal direction of the housing 14. The terminal receiving chambers 16 are provided to be arrayed in the width direction of the housing 14 while adjacent ones of the terminal receiving chambers 16 are divided by a partition wall 17. The opening in the side surface portion of the housing 14 is provided to face the terminal receiving chambers 16, and formed so that the retainer 13 can be assembled therein.

As shown in FIG. 2, each of the terminals 12 is formed by pressing a plate material made of metal. The terminal 12 is formed to have an electric connection portion 18 which makes contact with the bus bar 11, a crimp portion 20 which crimps a conductor part of a terminal of an electric wire 19, and a barrel portion 21 which crimps an insulating part of the electric wire 19. The electric connection portion 18 is formed into a cylindrical body shaped like a rectangular cylinder to have an elastically deformable elastic arm 22 folded back on an inner side of the cylindrical body. The elastic arm 22 is formed to be bent into a chevron shape in an insertion path of the bus bar 11. The elastic arm 22 can be pressed while abutting against the bus bar 11 with an apex 23 of the bent elastic arm 22 as a contact point portion. The contact point portion formed in the terminal 12 is not limited to such a configuration but may be formed into any configuration as long as it can press the bus bar 11 in elastic contact therewith.

When the terminals 12 formed thus are inserted up to set positions of the terminal receiving chambers 16 respectively, the terminals 12 are locked to lances (which will be described later) extending in insertion paths of the terminals 12 from inner walls of the terminal receiving chambers 16 respectively. The terminals 12 locked to the lances are positioned in the set positions of the terminal receiving chambers 16. In a state in which the terminals 12 are positioned in the terminal receiving chambers 16 respectively, rear ends of the electric connection portions 18 of the terminals 12 are locked to the retainer 13 which is assembled from the opening in the side surface portion of the housing 14. In this manner, the respective terminals 12 are locked doubly to the lances and the retainer 13. Incidentally, the retainer 13 is not essential as a constituent part of the connector.

Figure 3:
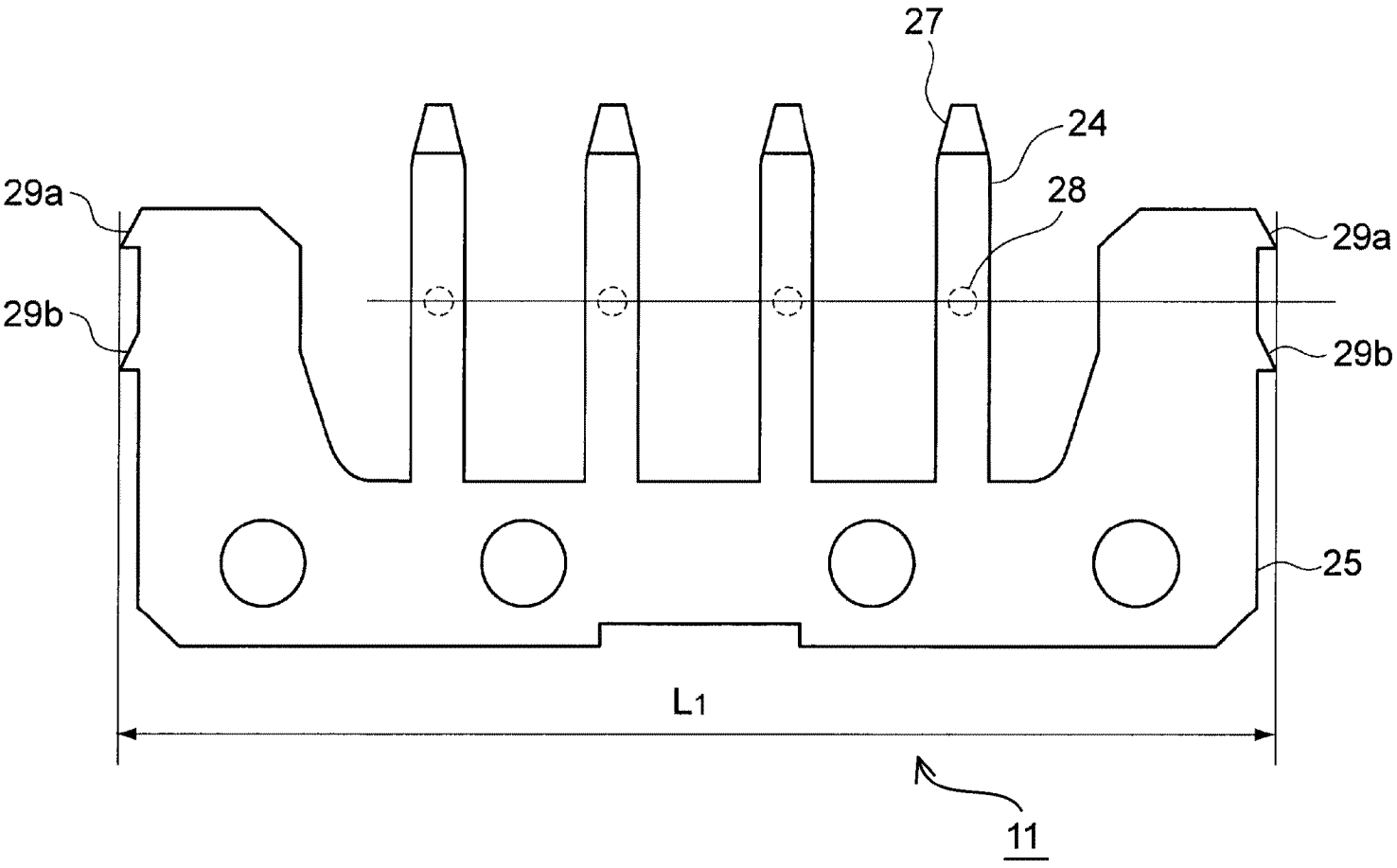
FIG. 3 is a plan view of a bus bar shown in FIG. 1.

As shown in FIG. 3, the bus bar 11 is formed by pressing a metal plate material shaped like a flat plate. The bus bar 11 has a plurality of (four in the embodiment) contact pieces 24 extending in one and the same direction, a coupling portion 25 coupling these contact pieces 24 to one another, and a pair of support portions 26 extending in the extension direction of the contact pieces 24 from widthwise opposite end portions of the coupling portion 25 respectively. The contact pieces 24, the coupling portion 25 and the support portions 26 are formed on one and the same plane in the bus bar 11.

Each of the contact pieces 24 is a long and narrow member shaped like a tab and extending from one end surface of the coupling portion 25. The contact pieces 24 are provided side by side at set intervals in the width direction of the coupling portion 25. Each of front end portions 27 of the contact pieces 24 is tapered so that its sectional area decreases gradually toward the front end surface. The contact pieces 24 are fitted into the electric connection portions 18 of the terminals 12 respectively so that the contact point portions (the apexes 23 of the elastic arms 22 in the embodiment) of the terminals 12 can make contact with contact portions 28 of the contact pieces 24. Although the dimensions and the shapes of the contact pieces 24 are the same as one another in the embodiment, contact pieces having different dimensions and shapes may be provided alternatively.

The pair of support portions 26 are provided on the opposite sides in the array direction of the contact pieces 24. Each support portion 26 is larger in widthwise thickness than each contact piece 24 and higher in rigidity than the contact piece 24. Two protrusions 29*a* and 29*b* are provided protrusively on an outer side surface of the support portion 26 (i.e. a side surface on an opposite side to the contact pieces 24). Each of the protrusions 29*a* and 29*b* substantially has a right triangular shape in plan view, in which a slope inclined downward in the extension direction of the support portion 26 is formed. In addition, the protrusions 29*a* and 29*b* are positioned so that the center between the protrusions 29*a* and 29*b* can come to the same position as the contact portion 28 of each contact piece 24 in the extension direction of the contact piece 24 (the front/rear direction of the housing 14). The bus bar 11 is set so that a maximum widthwise dimension L1 of the bus bar 11 including the protrusions 29*a* and 29*b* of the support portion 26 is larger than an inner widthwise dimension of the bus bar receiving chamber 15.

Figure 4:
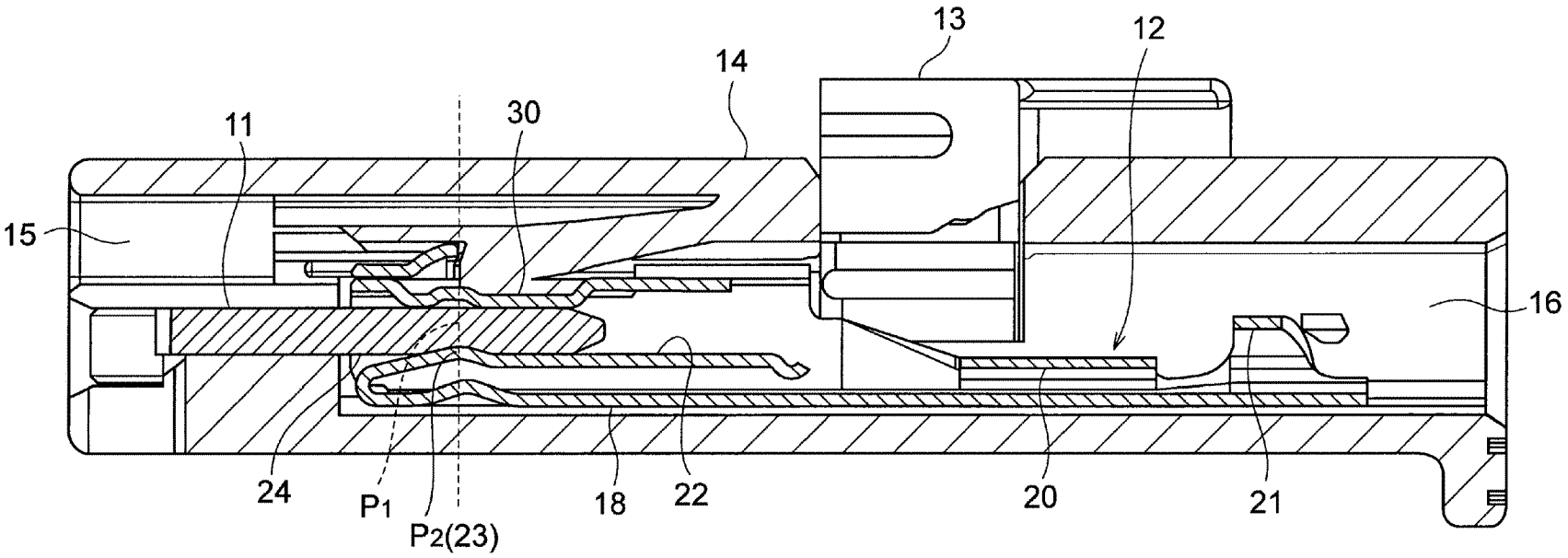
FIG. 4 is a longitudinal sectional view of the connector to which the embodiment of the invention is applied.
Figure 5:
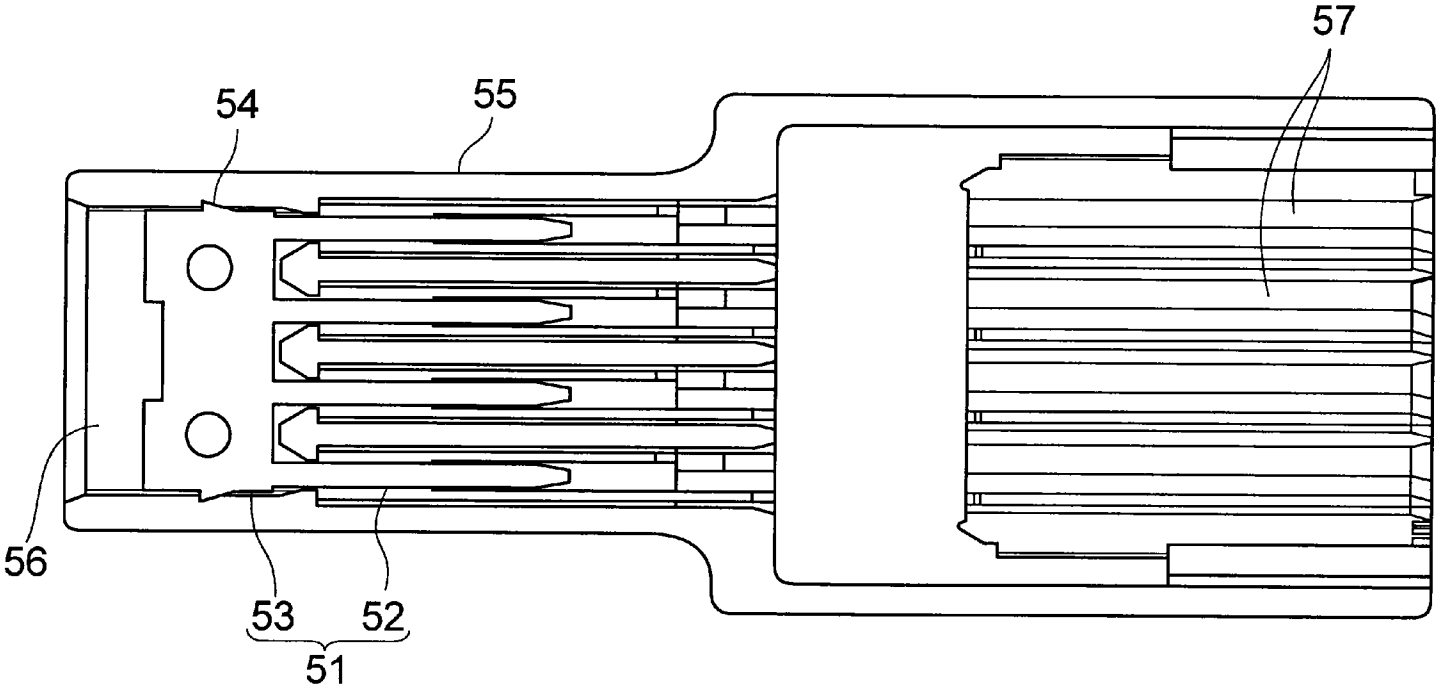
FIG. 5 is a sectional view showing a state in which a bus bar is assembled in a housing of a background-art connector.
Figure 6:
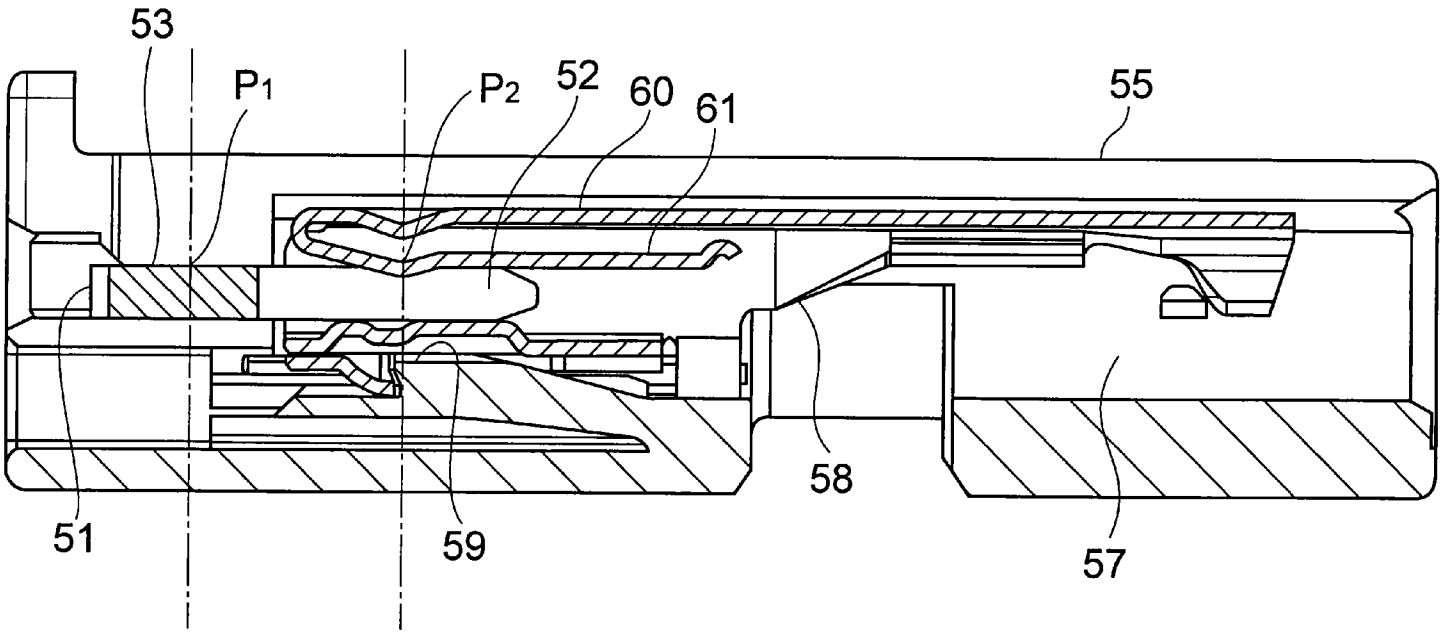
FIG. 6 is a longitudinal sectional view of the background-art connector

Next, an assembling procedure and an assembled configuration of the bus bar 11 and the terminals 12 will be described with reference to FIGS. 2 and 4. FIG. 4 is a longitudinal sectional view of the whole connector 10 corresponding to FIG. 2. As shown in FIG. 2, spaces divided separately from one another are provided side by side in the width direction in the bus bar receiving chamber 15. In the bus bar 11, the contact pieces 24 and the support portions 26 are inserted into the separate spaces respectively.

The bus bar 11 is inserted up to a stop position (a position in which a deep end surface of the bus bar receiving chamber 15 and front end portions of the support portions 26 of the bus bar 11 abut against each other) while pressing the protrusions 29*a* and 29*b* against an inner wall of the bus bar receiving chamber 15. In this case, the inner wall of the bus bar receiving chamber 15 is deformed concavely when the protrusions 29*a* and 29*b* pass therethrough. The deformation of the inner wall of the bus bar receiving chamber 15 is restored to some extent after the protrusions 29*a* and 29*b* have passed. Therefore, the protrusions 29*a* and 29*b* are locked to the inner wall. Thus, the bus bar 11 is retained in the housing 14 through the protrusions 29*a* and 29*b*. Incidentally, concave portions may be formed in the inner wall of the bus bar receiving chamber 15 so that the protrusions 29*a* and 29 can be engaged with the concave portions.

Successively, the terminals 12 to which the electric wires 19 have been connected are inserted into the terminal receiving chambers 16 of the housing 14 respectively. As sown in FIG. 4, the contact pieces 24 of the bus bar 11 are fitted into the electric connection portions 18 of the terminals 12 in the stop positions of the terminal receiving chambers 16 respectively, and the electric connection portions 18 which have climbed over lances 30 are positioned in the terminal receiving chambers 16 respectively. The contact pieces 24 of the bus bar 11 which are pressed against the apexes 23 of the elastic arms 22 in the electric connection portions 18 are connected to the terminals 12 respectively. In this manner, the terminals 12 are electrically connected to one another through the bus bar 11. Incidentally, since the retainer 13 is assembled in the housing 14, the terminals 12 can be positioned in the housing 14 more surely.

In FIGS. 2 and 4, a position where the bus bar 11 is fixed to the housing 14 (a position where the protrusions 29*a* and 29*b* are locked to the bus bar receiving chamber 15) is designated as the position P1, and a position where the contact pieces 24 (contact portions 28) of the bus bar 11 make contact with the contact point portions (apexes 23) of the terminals 12 is designated as the position P2 in the longitudinal direction of the housing 14. The connector 10 according to the embodiment is set so that the position P1 and the position P2 are aligned with each other in the longitudinal direction of the housing 14.

Here, when one protrusion 29 is provided in the longitudinal direction of the housing 14, the position P1 means the position of the protrusion 29. When protrusions 29 are provided in the longitudinal direction of the housing 14, the position P1 means an inner area between two of the protrusions 29 located at the opposite ends in the longitudinal direction. In the embodiment, the position of the center between the two protrusions 29*a* and 29*b* is set as the position P1.

On the other hand, when each contact piece 24 of the bus bar 11 and the contact point portion (apex 23) of each terminal 12 make contact with each other at one place, the position P2 means the position of the contact place. When the contact piece 24 of the bus bar 11 and the contact point portion of the terminal 12 make contact with each other at places in the longitudinal direction of the housing 14, the position P2 means an inner area between two of the contact places located at the opposite ends in the longitudinal direction. In the embodiment, the position of the contact portion 28 of the contact piece 24 is set as the position P2.

As described above, in the connector 10 according to the embodiment, the bus bar 11 is formed to have the protrusions 29*a* and 29*b* in the support portions 26 extending in the extension direction of the contact pieces 24 from the coupling portion 25. Accordingly, the position P1 and the position P2 can be aligned with each other in the longitudinal direction of the housing 14. According to this, the distance between the position P1 and the position P2 in the longitudinal direction of the housing 14 is zero so that the distance of relative movement between the position P1 and the position P2 caused by volume change of the housing can be shortened. Therefore, displacement between the bus bar 11 and the terminals 12 can be suppressed so that the contact state between the bus bar 11 and the terminals 12 can be made stable. Accordingly, plating can be prevented from being peeled due to friction between the bus bar 11 and the terminals 12 so that rust can be prevented from occurring or electric resistance can be prevented from increasing. Accordingly, electric reliability of the connector 10 can be enhanced.

In addition, the bus bar 11 according to the embodiment has the protrusions 29*a* and 29*b* provided in the support portions 26 which are different from the contact pieces 24. Accordingly, the protrusions 29*a* and 29*b* can be provided in desired positions so that the degree of freedom in designing the bus bar 11 and the terminals 12 can be enhanced. In addition, since the protrusions 29*a* and 29*b* are provided in the support portions 26 configured thus, the structure of each terminal 12 can be prevented from being complicated, for example, in order to avoid interference between the protrusions 29*a* and 29*b* and the terminal 12. Accordingly, manufacturing cost can be suppressed inexpensively.

In addition, in the bus bar 11 according to the embodiment, the four contact pieces 24, the coupling portion 25 and the pair of support portions 26 are formed on one and the same plane. Accordingly, the protrusions 29*a* and 29*b* can be provided in desired positions without changing the thickness of the bus bar 11. Accordingly, electric reliability of the connector 10 can be secured without increasing the thickness of the connector 10.

Although the embodiment of the invention has been described above in detail with reference to the drawings, the aforementioned embodiment is merely described as an example of the invention. The invention is not limited only to the configuration of the aforementioned embodiment.

Even when there is a design change etc. without departing from the gist of the invention, it is a matter of course that the design change etc. is included in the invention.

For example, although the case where two protrusions 29*a* and 29*b* are provided in each of the pair of support portions 26 of the bus bar 11 has been described by way of example in the aforementioned embodiment, one protrusion 29 or three or more protrusions 29 may be provided alternatively in each support portion 26. In addition, although the sizes and shapes of the contact pieces 24 are set to be the same as one another in the aforementioned embodiment, the contact pieces 24 may be formed to have different sizes and shapes from one another.

Here, the aforementioned characteristics of the embodiment of the connector according to the invention will be summarized briefly and listed in the following items [1] to [3] respectively.

[1] A connector (10) including:

a plurality of terminals (12) configured to connect to electric wires (19);

a bus bar (11) configured to electrically connects the plurality of terminals (12) to one another; and a housing (14) that includes a plurality of terminal receiving chambers (16) and a bus bar receiving chamber (15), the terminal receiving chambers (16) configured to receive and position the plurality of terminals (12) therein, and the bus bar receiving chamber (15) configured to receive the bus bar (11), wherein the bus bar (11) includes a plurality of contact pieces (24), a coupling portion (25), and support portions (26), the contact pieces (24) being brought into contact with elastically contactable contact point portions (apexes 23) provided in the plurality of terminals (12), the plurality of contact pieces (24) extending in one and the same direction, the coupling portion (25) coupling the plurality of contact pieces (24), the support portions (26) extending in the extension direction of the plurality of contact pieces (24) from both end portions of the coupling portion (25) in its widthwise direction respectively, protrusions (29*a*, 29*b*) being provided in the support portions (26) and being configured to be locked to the bus bar receiving chamber (15); and wherein a position (P2) where the plurality of contact pieces (24) make contact with the contact point portions (apexes 23) of the plurality of terminals (12) and a position (P1) where the protrusions (29*a*, 29*b*) are locked to the bus bar receiving chamber (15) are set to be aligned with each other in a longitudinal direction of the housing (14).

[2] The connector (10) according to the aforementioned item [1], wherein the plurality of contact pieces (24), the coupling portion (25) and the support portions (26) are provided on one and the same plane in the bus bar (11).

In addition, the present application is based on a Japanese patent application (Patent Application No. 2014-085425) which was filed on Apr. 17, 2014 and the contents of which are incorporated herein by reference.

INDUSTRIAL APPLICABILITY

According to the connector according to the invention, it is possible to suppress displacement between the bus bar and the terminals so that it is possible to make a contact state between the bus bar and the terminals stable. Accordingly, it is possible to prevent plating from being peeled due to friction between the bus bar and the terminals so that it is possible to prevent rust from occurring or prevent electric resistance from increasing. Thus, it is possible to enhance electric reliability of the connector.

REFERENCE SIGNS LIST

10 connector
11 bus bar
12 terminal
14 housing
15 bus bar receiving chamber
16 terminal receiving chamber
18 electric connection portion
19 electric wire
22 elastic arm
23 apex (contact point portion)
24 contact piece
25 coupling portion
26 support portion
29*a*, 29*b* protrusion

The invention claimed is:

1. A connector comprising:

a plurality of terminals configured to connect to electric wires;

a bus bar configured to electrically connects the plurality of terminals to one another; and a housing that comprises a plurality of terminal receiving chambers and a bus bar receiving chamber, the terminal receiving chambers configured to receive and position the plurality of terminals therein, and the bus bar receiving chamber configured to receive the bus bar, wherein the bus bar comprises a plurality of contact pieces, a coupling portion, and support portions, the contact pieces being brought into contact with elastically contactable contact point portions provided in the plurality of terminals, the plurality of contact pieces extending in one and the same direction, the coupling portion coupling the plurality of contact pieces, the support portions extending in an extension direction of the plurality of contact pieces from both end portions of the coupling portion in its widthwise direction respectively, protrusions being provided in the support portions and being configured to be locked to the bus bar receiving chamber, wherein a position where the plurality of contact pieces make contact with the contact point portions of the plurality of terminals and a position where the protrusions are locked to the bus bar receiving chamber are set to be aligned with each other in a longitudinal direction of the housing such that the protrusions are inserted into the housing as far along the longitudinal direction as at least a portion of the plurality of contact pieces in contact with the contact point portions, wherein the position, where the plurality of contact pieces make contact with the contact point portions of the plurality of terminals, is a first position, wherein the position, where the protrusions are locked to the bus bar receiving chamber, is a second position, wherein, in a cross-section through the housing and perpendicular to the longitudinal direction, the first position and the second position are adjacent to each other in the cross-section, and wherein the protrusions are closer to tin ends of the contact nieces than to an end of the bus bar opposite the tip ends.

2. The connector according to claim 1, wherein the plurality of contact pieces, the coupling portion and the support portions are provided on one and the same plane in the bus bar.

3. The connector according to claim 1, wherein the bus bar comprises the protrusions and a second plurality of protrusions, wherein ones of the protrusions and the second plurality of protrusions are aligned in the longitudinal direction, and the position where the protrusions are lock corresponds to a position between the ones of the protrusions and the second plurality of protrusions in the longitudinal direction.

4. The connector according to claim 1, wherein the contact pieces are aligned with the protrusions in the longitudinal direction.

5. The connector according to claim 1, wherein the longitudinal direction is also an insertion direction in which housing is configured to receive the bus bar inserted thereto, and in the insertion direction, a distance at which the protrusions are inserted into the housing is approximately a distance at which a portion of the contact pieces contacting the contact point portions is inserted into the housing.

6. The connector according to claim 1, wherein, of all parts of the bus bar, the tip ends are inserted furthest into the housing, and wherein of all the parts of the bus bar, the end, of the bus bar opposite the tip ends, is inserted least into the housing and is also furthest from the tip ends.

7. A connector comprising:

a plurality of terminals configured to connect to electric wires;

a bus bar configured to electrically connects the plurality of terminals to one another; and a housing that comprises a plurality of terminal receiving chambers and a bus bar receiving chamber, the terminal receiving chambers configured to receive and position the plurality of terminals therein, and the bus bar receiving chamber configured to receive the bus bar, wherein the bus bar comprises a plurality of contact pieces, a coupling portion, and support portions, the contact pieces being brought into contact with elastically contactable contact point portions provided in the plurality of terminals, the plurality of contact pieces extending in one and the same direction, the coupling portion coupling the plurality of contact pieces, the support portions extending in an extension direction of the plurality of contact pieces from both end portions of the coupling portion in its widthwise direction respectively, protrusions being provided in the support portions and being configured to be locked to the bus bar receiving chamber, wherein a position where the plurality of contact pieces make contact with the contact point portions of the plurality of terminals and a position where the protrusions are locked to the bus bar receiving chamber are set to be aligned with each other in a longitudinal direction of the housing such that the protrusions are inserted into the housing as far along the longitudinal direction as at least a portion of the plurality of contact pieces in contact with the contact point portions, wherein the position, where the plurality of contact pieces make contact with the contact point portions of the plurality of terminals, is a first position, wherein the position, where the protrusions are locked to the bus bar receiving chamber, is a second position, wherein, in a cross-section through the housing and perpendicular to the longitudinal direction, the first position and the second position are adjacent to each other in the cross-section, wherein, of all parts of the bus bar, the tip ends are inserted furthest into the housing, and wherein of all the parts of the bus bar, the end, of the bus bar opposite the tip ends, is inserted least into the housing and is also furthest from the tip ends.

* * * * *